US005823642A

United States Patent [19]

Korolainen

[11] Patent Number: 5,823,642

[45] Date of Patent: Oct. 20, 1998

[54] ADP-TABLE

[76] Inventor: Jussi Korolainen, Sinikalliontie 1, FIN-02630 Espoo, Finland

[21] Appl. No.: 737,266

[22] PCT Filed: May 5, 1995

[86] PCT No.: PCT/FI95/00240

§ 371 Date: Nov. 5, 1996

§ 102(e) Date: Nov. 5, 1996

[87] PCT Pub. No.: WO95/30355

PCT Pub. Date: Nov. 16, 1995

[30] Foreign Application Priority Data

May 5, 1994 [FI] Finland ..... 940270 U

[51] Int. Cl.[6] ..... A47B 81/06

[52] U.S. Cl. ..... 312/7.2; 312/223.3

[58] Field of Search ..... 248/917, 919, 248/920, 921, 922, 923, 924; 312/223.3, 196, 3, 4, 5, 6; 108/50, 92, 24

[56] References Cited

U.S. PATENT DOCUMENTS 5,087,010 2/1992 Walters ..... 312/7.2

5,290,099 3/1994 Lechman ..... 312/223.3

FOREIGN PATENT DOCUMENTS 8807826 10/1988 WIPO .

9307779 9/1993 WIPO .

*Primary Examiner*—Peter M. Cuomo

*Assistant Examiner*—Gerald A. Anderson

*Attorney, Agent, or Firm*—Stephan A. Pendorf, P.A.

[57] ABSTRACT

The invention relates to a computer desk, comprising a glass sheet (1) forming a top or a portion thereof, a keyboard level (2) in front of it and a monitor space (5) below the glass sheet (1) provided with suspension elements (6–8) for suspending a monitor (4) in an inclined position below the glass sheet (1). The suspension elements (6–8) include a flexible net (7), upon which the monitor (4) can be set. The opposite ends of the net have a suspension height which is adjustable for adjusting the angular position of the monitor. The monitor space (5) is confined on substantially all four sides by metal walls (9–11).

8 Claims, 1 Drawing Sheet

ADP-TABLE

The present invention relates to a computer desk, comprising a glass sheet forming a top or a portion thereof, a keyboard level in front of it and a monitor space below the glass sheet provided with suspension elements for suspending a monitor in an inclined position below the glass sheet.

This type of computer desk is prior known e.g. from Patent publication FI-77967. An object of the invention is to develop such a computer desk further regarding the monitor suspension and protection.

According to the invention, this object is achieved such that said suspension elements include a flexible net, upon which a monitor is placeable and whose opposite ends have a suspension height that is adjustable in view of adjusting the angular position of the monitor, and that the monitor space is confined on essentially all four sides by metal walls.

By virtue of the invention a monitor can be readily and quickly set in its proper angular position. At the same time, the operator is protected from both static electricity and electric and magnetic fields. The metal case can also be used for the improvement of information safety by making the all-covered case locked such that the monitor cannot be switched on without a key.

Figure 1:
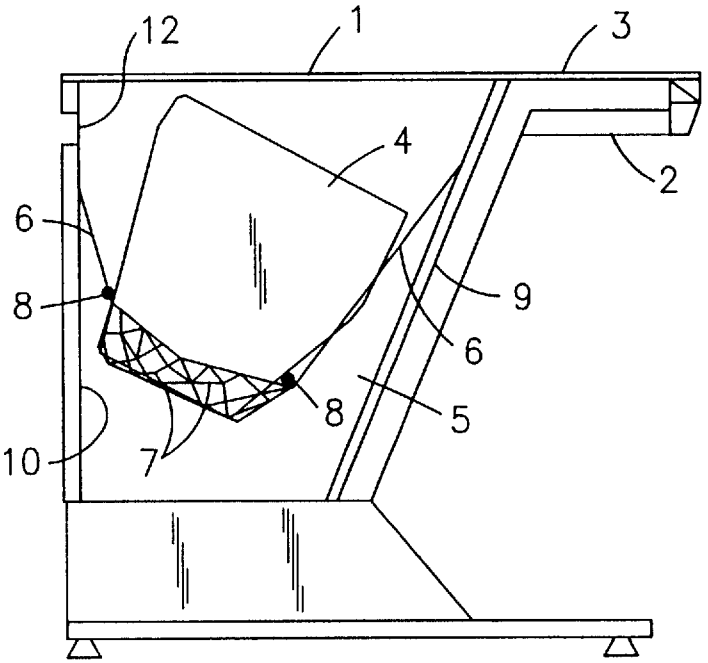
Figure 2:
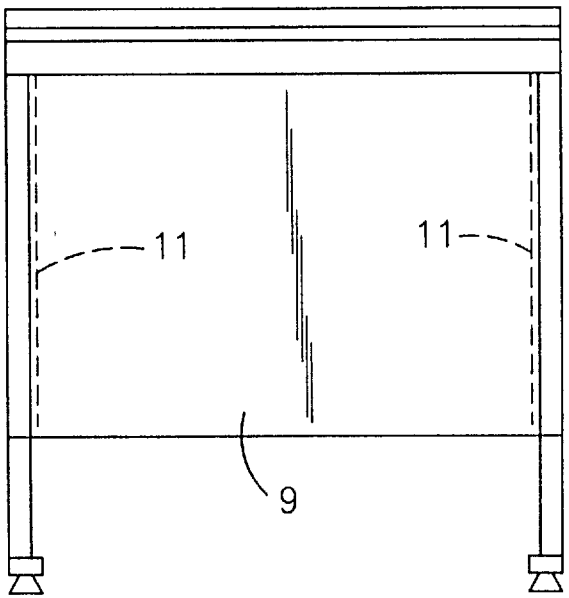

One embodiment of the invention will now be described in more detail with reference made to the accompanying drawings, in which FIG. 1 shows a side view of a computer desk of the invention with a side sheet removed;

FIG. 2 shows a frontal view of the same computer desk.

The figures only illustrate a basic desk module that can be surrounded with desk tops of desired sizes as well as with sets of drawers therefor.

The desk top comprises a glass sheet 1, which in a finished desk generally forms just a portion of the desk top. The glass sheet 1 is preceded by a keyboard level 2, which is covered by a keyboard lid 3 that can be shifted aside from above the keyboard. Below the glass sheet 1 is a monitor space 5, which is provided with suspension elements 6–8 for suspending a monitor in an inclined position below the glass sheet 1.

The suspension elements include flexible belts 6, upon which is placed a flexible net 7 by means of a transverse wood blocks 8. A monitor 4 can be set to rest on the net 7 between belts 6 and blocks 8. The opposite ends of net 7 are secured to blocks 8 and, thus, the blocks can be manipulated along the belts 6 for adjusting the angular position of said monitor 4. In addition, the suspension can be adapted to monitors of various sizes by means of the length adjustment of the belts 6.

The monitor space is confined on substantially on all four sides by metal walls, namely an inclined front wall 9, a vertical rear wall 10 and vertical side walls 11. In addition, the metal walls can be covered from outside with siding plates at least on the front and rear sides.

The bottom of a metal case 9–11 can be open and, in addition, the top edge of the rear side can be provided with a grate 12 for the circulation of air. The metal case provides a good dust protector compared to an open space and, if desired, the case can be given a slight positive pressure for protecting the monitor completely from dust. In addition, the case should be provided with an earthing facility, e.g. by providing the case with a screw for an earth conductor.

Thus, a computer desk of the invention merits the following benefits:

elimination of static electricity elimination of electric field by more than 90% elimination of magnetic field by 40–80% dust tightness possibility for improved information safety.

I claim:

1. A computer desk, said desk having an upper surface, a front side, a back side, and left and right sides, wherein said upper surface includes a sheet of glass and a keyboard level on the front side of said computer desk, said computer desk having a monitor area located below said sheet of glass, wherein said monitor area is provided with suspension elements connected to said desk and a flexible net having a front side and a back side and adjustably attached to said suspension elements at said flexible net front side and back side, said flexible net and suspension elements cooperating for receiving and suspending a monitor in an inclined position below said glass sheet, wherein the angular position of said monitor is adjustable by adjustment of the position of said flexible net along said suspension elements, and wherein said monitor area is surrounded on at least four sides by metal walls.

2. A computer desk as in claim 1, wherein said flexible net is secured to said suspension elements via transverse wood blocks.

3. A computer desk as in claim 2, wherein said wood blocks are positionable along said suspension elements.

4. A computer desk as in claim 1, wherein said suspension elements are flexible belts.

5. A computer desk, said desk having an upper surface, a front side, a back side, and left and right sides, wherein said upper surface includes a sheet of glass and a keyboard level on the front side of said desk, said computer desk having a monitor area located below said sheet of glass, wherein said monitor area is provided with suspension elements connected to said desk and a flexible net connected to said suspension elements, said suspension elements and flexible net adapted for receiving and suspending a monitor in an inclined position below said glass sheet, wherein the length of said suspension elements is adjustable, and wherein said monitor area is surrounded on at least four sides by metal walls.

6. A computer desk as in claim 5, wherein said flexible net is secured to said suspension elements via transverse wood blocks.

7. A computer desk as in claim 6, wherein said wood blocks are positionable along said suspension elements.

8. A computer desk as in claim 5, wherein said suspension elements are flexible belts.

* * * * *